US007210514B2

(12) United States Patent
Shinki et al.

(10) Patent No.: US 7,210,514 B2
(45) Date of Patent: May 1, 2007

(54) DIE CASTING MACHINE

(75) Inventors: Yoshiyuki Shinki, Toyota (JP); Isamu Izutsu, Toyota (JP); Akira Nishiyama, deceased, late of Toyota (JP); by Kazuko Nishiyama, legal representative, Toyota (JP)

(73) Assignee: Taiho Kogyo Co., Ltd., Toyota-shi, Aichi (JP)

( * ) Notice: Subject to any disclaimer, the term of this patent is extended or adjusted under 35 U.S.C. 154(b) by 0 days.

(21) Appl. No.: 11/165,646

(22) Filed: Jun. 24, 2005

(65) Prior Publication Data

US 2006/0000573 A1 Jan. 5, 2006

(30) Foreign Application Priority Data

Jun. 30, 2004 (JP) ..... 2004-193317
May 30, 2005 (JP) ..... 2005-157693

(51) Int. Cl.
*B22D 17/10* (2006.01)

(52) U.S. Cl. ..... 164/72; 164/267; 164/312

(58) Field of Classification Search ..... 164/72, 164/267, 312
See application file for complete search history.

(56) References Cited

U.S. PATENT DOCUMENTS 3,767,012 A * 10/1973 Jimi et al. ..... 184/5
6,752,197 B2 * 6/2004 Mortari ..... 164/61

FOREIGN PATENT DOCUMENTS

JP 06-142877 5/1994
JP 11-077274 3/1999

* cited by examiner

*Primary Examiner*—Kuang Y. Lin
(74) *Attorney, Agent, or Firm*—Flynn, Thiel, Boutell & Tanis, P.C.

(57) ABSTRACT

A lubricant oil feeder 2 of a due casting machine 1 is made up of a lubricant oil feed passage 19 for feeding a lubricant oil into a clearance between the inner peripheral surface of a sleeve 7 and the outer peripheral surface of an injection piston 9, a lubricant oil feed valve 20 for opening or closing the lubricant oil feed passage, an air feed passage 16 for feeding air into a clearance between the inner peripheral surface of the sleeve and the outer peripheral surface of the injection piston, and an air feed valve 18 for opening and closing the air feed passage, and the arrangement is such that the lubricant oil feed valve is initially opened to feed the lubricant oil into the clearance between the sleeve and the injection piston and the air feed valve is then opened to pump the lubricant oil by the air.

It is possible to spread the lubricant oil extensively and quickly, and accordingly, the useful life of the sleeve and the injection piston can be improved with a reduced quantity of lubricant oil. The generation of gas a a result of a reaction with molten metal within the sleeve can also be suppressed, thus allowing the occurrence of a casting cavity to be prevented and the quality of a product to be improved.

4 Claims, 3 Drawing Sheets

DIE CASTING MACHINE

FIELD OF THE INVENTION

The present invention relates to a die casting machine, and more particularly, to an improvement in a lubricant oil feeding means which feeds a lubricant oil into a clearance between the inner peripheral surface of a sleeve and the outer peripheral surface of an injection piston.

DESCRIPTION OF THE PRIOR ART

A die casting machine is well known in the art which comprises at least two or a first and a second die which are disposed in abutment against each other to define a casting space therebetween, a sleeve mounted on the first die and communicating with the casting space, an injection piston slidably disposed within the sleeve for injecting molten metal fed into the sleeve into the casting space, drive means for reciprocating the injection piston, and lubricant oil feeding means for feeding a lubricant oil into a clearance between the inner peripheral surface of the sleeve and the outer peripheral surface of the injection piston.

An arrangement is known for a lubricant oil feeding means in which a nozzle communicating with a supply of lubricant oil has its distal end disposed above an end face of the sleeve to cause the lubricant oil to drip down from the distal end of the nozzle towards the clearance between the sleeve and the injection piston (Japanese Laid-Open Patent Application 77274/1999).

Another arrangement for the lubricant oil feeding means is also known in which the lubricant oil is fed as a mist from a spray nozzle (Japanese Laid-Open Patent Application 142877/1994) rather than dripping it down.

However, with either lubricant oil feeding means, it is difficult to cause the lubricant oil to be spread around both peripheral surfaces from the clearance between the end face of the sleeve and the end face of the injection piston, causing an early abrasion of portions which are not covered by the lubricant oil or which require time until they are covered by the lubricant oil to have an influence on the useful life of the sleeve and the injection piston.

To overcome above problem, it may be contemplated to increase the supply of the lubricant oil, but when the amount of lubricant oil supplied is more than is required, there results a disadvantage that an excess amount of lubricant oil reacts with molten metal to be gasified during a pouring operation and causes cavities to be generated or causes an imperfect plating.

SUMMARY OF THE INVENTION

In view of the foregoing, the present invention intends to provide a die casting machine including a lubricant oil feeding means which improves the useful life of the sleeve and the injection piston as compared with the prior art.

Specifically, the present invention relates to a die casting machine comprising at least two or a first and a second die disposed in abutment against each other to define a casting space therebetween, a sleeve mounted on the first die and communicating with the casting space, an injection piston slidably disposed within the sleeve for injecting molten metal supplied through the sleeve into the casting space, drive means for reciprocating the injection piston, and lubricant oil feeding means for feeding a lubricant oil into a clearance between the inner peripheral surface of the sleeve and the outer peripheral surface of the injection piston. In accordance with the present invention, the lubricant oil feeding means comprises a lubricant oil feed passage for feeding a lubricant oil into a clearance between the inner peripheral surface of the sleeve and the outer peripheral surface of the injection piston, and an air feed passage for feeding air into a clearance between the inner peripheral surface of the sleeve and the outer peripheral surface of the injection piston. The air in the air feed passage is effective to pump the lubricant oil from the lubricant oil feed passage into the clearance between the outer peripheral surface of the injection piston and the inner peripheral surface of the sleeve.

With the lubricant oil feeding means mentioned above, since the lubricant oil is pumped by the air, it is possible to allow a required minimum amount of lubricant oil to be spread quickly and extensively around the outer peripheral surface of the injection piston.

Accordingly, the useful life of the sleeve and the injection piston can be improved with an amount of lubricant oil which is reduced as compared with the prior art and the generation of gas which would result from a reaction with molten metal within the sleeve can be suppressed, thus preventing a casting cavity from occurring and improving the quality of the products.

The above and other objects and advantages of the invention will become apparent from the following description of an embodiment thereof with reference to the drawings.

DETAILED DESCRIPTION OF THE EMBODIMENT

Figure 5:
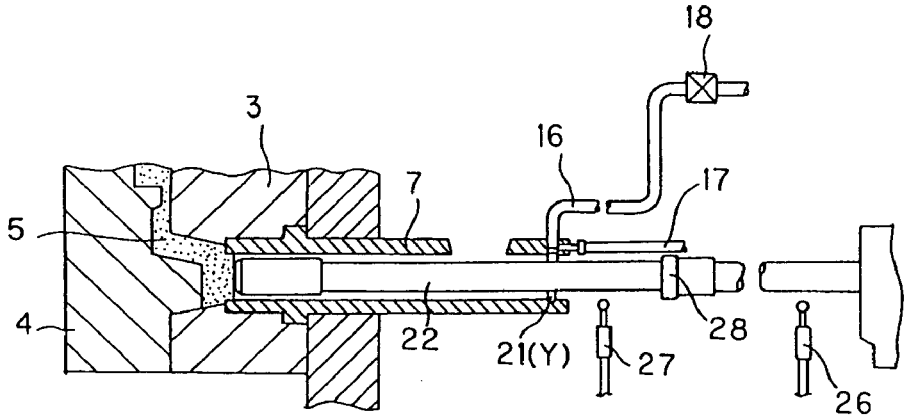
FIG. 5 is a side elevation illustrating a pouring operation.

An embodiment of the invention shown in the drawings will now be described. There is shown a compact size die casting machine 1, to which lubricant oil feeding means 2 according to the invention is applied. The die casting machine 1 comprises a fixed die 3 acting as a first die which is mounted on a stationary frame, not shown, and a movable die 4 acting as a second die (see FIG. 5) which is driven for reciprocating motion toward and away from the fixed die 3, and when the movable die 4 is brought into abutment against the fixed die 3, a closed casting space 5 (see FIG. 5) is defined therebetween.

A sleeve 7 is disposed in the fixed die 3 and communicates with the casting space 5 and is internally formed with a sprue runner 6. An injection piston 9 is slidably disposed within the sleeve 7 and is driven for reciprocatory motion therein by drive means, not shown.

Figure 1:
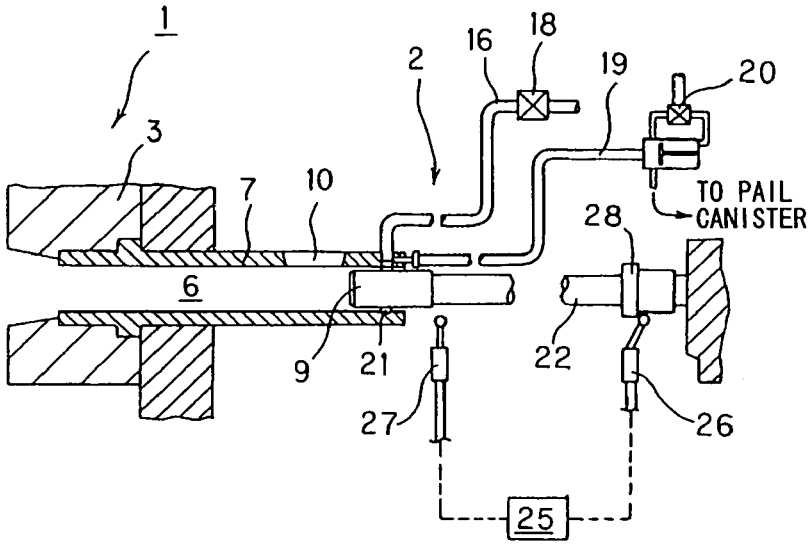
FIG. 1 is a side elevation of one embodiment of the present invention.

At its one end, the sleeve 7 is notched in its upper portion to provide a gate 10 which allows molten metal to be poured into the sleeve. The molten metal is poured into the sleeve when the injection piston 9 assumes its retreated position as shown in FIG. 1.

It is to be noted that a clearance between the sleeve 7 and the injection piston 9 depends on the size of these members, but is generally very small on the order of 0.03 to 0.06 mm.

As a consequence, with the prior art practice of dripping lubricant oil into the clearance between the end face of the sleeve and the end face of the injection piston, there may be portions around the inner peripheral surface of the sleeve or the outer peripheral surface of the injection piston where lubricant oil is not spread, or it may take a length of time until lubricant oil is spread over these portions. In these portions, abrasion proceeds in an accelerated manner, influencing the useful life of the sleeve and the injection piston.

However, the lubricant oil feeding means 2 of the present embodiment is designed to improve the useful life of the sleeve 7 and the injection piston 9 as compared with the lubricant oil feeding means of the prior art as mentioned above.

Figure 2:
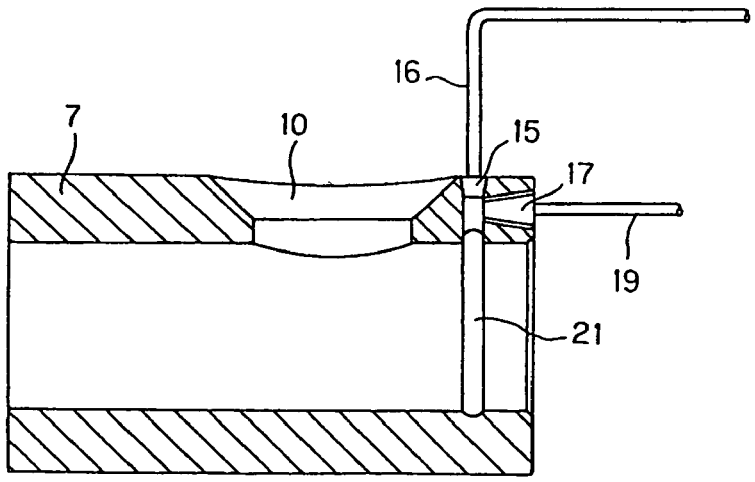
FIG. 2 is an enlarged section of a rear end of a sleeve 7.

Specifically, as indicated in FIG. 2, the lubricant oil feeding means 2 comprises an air feed passage 16 connected to a flute 15 formed around the outer periphery of the sleeve 7 at a location toward the rear end thereof and communicating with the interior of the sleeve 7 through the flute 15, and a lubricant oil feed passage 19 connected to a transverse slot 17 which communicates with the flute 15 to be in communication with the interior of the sleeve through the transverse slot 17 and the flute 15. The air feed passage 16 is connected with a compressor, not shown, which serves as a air supply, and an air supply valve 18 is disposed therein to open or close the passage, as shown in FIG. 1. The lubricant oil feed passage 19 is connected to an air cylinder which serves as a source of lubricant oil supply, and an air switching valve which supplies air to or displaces it from the air cylinder or a lubricant oil feed valve 20 is disposed in the passage.

Figure 3:
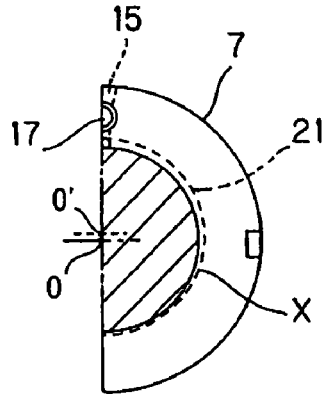
FIG. 3 is a right-hand side elevation of the sleeve 7 and an injection piston 9.

As shown in FIGS. 2 and 3, an annular groove 21, which is arcuate in section and extends continuously circumferentially, is formed in the inner peripheral surface of the sleeve 7, and the flute 15 opens into the groove 21. Thus both the air feed passage 16 and the lubricant feed passage 19 open into the groove 21.

Accordingly, when the injection piston 9 is located at its retreated position, an annular space X having a greater clearance than the above mentioned clearance (0.03 to 0.06 mm) is formed between the groove 21 and the outer peripheral surface of the injection piston 9.

The circumferentially continuous groove 21 has a center O' which is located with an offset on the order of 1 to 5 mm above the center O of the sleeve 7, whereby the groove 21 has a depth which is shallow downward and deep upward. As a consequence, the volume of the groove 21 is reduced downward as compared with upward, and accordingly, if the quantity of the lubricant oil which is held as a reservoir in the lower portion of the groove 21 as the oil is fed from the upwardly located lubricant oil feed passage 19 is small, the liquid level rises quickly within the groove 21, whereby the oil is quickly spread circumferentially over the entire area of the outer peripheral surface of the injection piston 9.

Figure 4:
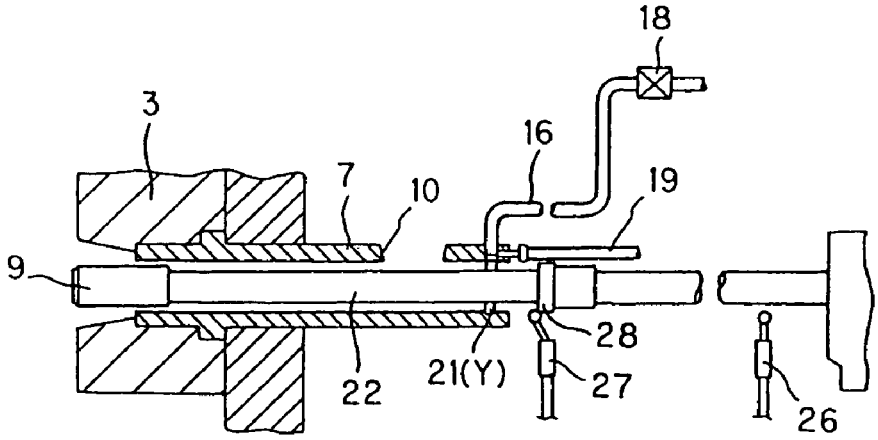
FIG. 4 is a side elevation illustrating an idling operation of the injection piston.

A connecting rod 22 which connects between the injection piston 9 and drive means has an external diameter which is chosen to be suitably less than the external diameter of the injection piston 9, whereby when the connecting rod 22 is inserted into the sleeve 7, a clearance between the inner peripheral surface of the sleeve 7 and the outer peripheral surface of the connecting rod 22 is greater than the clearance between the sleeve 7 and the injection piston 9 while an annular space Y (refer FIGS. 4 and 5) which is greater than this clearance is formed between the groove 21 and the outer peripheral surface of the connecting rod 22.

The air feed valve 18 and the lubricant oil feed valve 20 are adapted to be controlled to open and close by a controller 25 which controls the entire die casting machine 1. A first and a second touch sensor 26 and 27, which are a pair of detectors disposed on the locus of movement of the connecting rod 22 which operatively associates the injection piston 9 with the drive means, provide inputs indicating that the injection piston 9 is located at either a retreated position or an advanced position.

The first touch sensor 26 is disposed close to the drive means while the second touch sensor 27 is disposed close to the fixed die 3. An abutment member 28 which projects radially outward from the outer periphery of the connecting rod 22 abuts against either touch sensor 26 or 27. Specifically, the first touch sensor 26 detects that the injection piston 9 is located at the retreated position shown in FIG. 1 and the second touch sensor 27 detects that the injection piston 9 is located at the advanced position shown in FIG. 4.

The controller 25 will now be described. In response to an input from the first touch sensor 26 indicating that the injection piston 9 is located at the retreated position as shown in FIG. 1, the controller 25 opens the lubricant oil feed valve 20 of the lubricant oil feeding means 2 for a given time interval to feed the lubricant oil, then closes it, then opens the air feed valve 18 for a given time interval to feed air, and then closes it prior to the pouring operation.

When the lubricant oil feeding means 2 has fed the lubricant oil and the air, an idling operation takes place by causing the drive means to advance the injection piston 9 to its advanced position while there is no molten metal in the sleeve 7 and this condition is maintained for a while. At this point, the air feed valve 18 is opened for a given time to feed the air and is then closed.

The drive means then causes the injection piston 9 to retreat from the advanced position to the retreated position, a molten metal which may comprise aluminum alloy, for example, is poured into the sleeve 7 subsequently by pouring means and then the drive means drives the injection piston 9 forward to inject the molten metal in the sleeve 7 into the casting space 5 for the purpose of a casting operation. Under this condition, the drive means is maintained still momentarily while the pouring means is returned to prepare for the next pouring operation. At this time, the injection piston 9 still remains intermediate the advanced position and the retreated position while applying a pressure to the molten metal in the casting space 5 (see FIG. 5).

When the aluminum alloy in the casting space 5 is solidified, the movable die 4 is retreated while the injection piston is advanced to the advanced position to take out a casting. At this time, the abutment member 28 abuts against the second touch sensor 27 to provide an input indicating that the injection piston 9 is located at the advanced position, whereupon the air feed valve 18 of the lubricant oil feeding means 2 is opened to feed only the air into the groove 21, thus removing metal residues (burrs) and metal powders by blowing them away and the machine is left in a standby condition for a while until the forward end of the injection piston 9 is cooled down. This is to prevent the inner surface of the sleeve 7 and the outer peripheral surface of the injection piston 9 from being damaged by a retreating movement of the injection piston 9 under the condition that the forward end of the injection piston 9 is expanded to a degree exceeding a clearance with respect to the sleeve 7 as a result of a direct contact with the molten metal.

When the forward end of the injection piston 9 has cooled down, the drive means is used to retreat the injection piston 9 to its retreated position (see FIG. 1). At this time, when the first touch sensor 26 provides an input indicating that the injection piston 9 is located at its retreated position, the lubricant oil feed valve 20 is opened for a given time interval to feed the lubricant oil as before, followed by opening the air feed valve for a given time interval to feed the air. Subsequently, the controller 25 repeats the described control operation.

Describing the operation of the lubricant oil feeding means 2 of the die casting machine 1 mentioned above, under the condition shown in FIG. 1 where the movable die 4 is separate from the fixed die 3 and the injection piston 9 is located at its retreated position or the condition which prevails before the pouring operation, the controller 25 initially opens the lubricant oil feed valve 20 for a given time interval to deliver the lubricant oil through an air cylinder. This lubricant oil of a given quantity is fed through the lubricant oil feed passage 19, the transverse slot 17 and the flute 15 into the groove 21, or more specifically, into an extensive annular space X formed between the groove 21 in the sleeve 7 and the outer peripheral surface of the injection piston 9.

Since the center O' of the groove 21 is offset upwardly from the center O of the sleeve 7, if the quantity of the lubricant oil fed from the lubricant oil feed passage 19 is small, the lubricant oil can quickly spread circumferentially over the entire outer peripheral surface of the injection piston 9.

When a given quantity of lubricant oil has been introduced into the annular space X, the air feed valve 18 is then opened for a given time interval to feed the air into the annular space X through the air feed passage 16 and the flute 15, whereby the internal pressure of the annular space X rises to cause the air in the annular space X to find its way out through a clearance between the inner peripheral surface of the sleeve 7 (toward the rear end) and the outer peripheral surface of the injection piston 9. This allows the lubricant oil which has been introduced into the annular space X to be pumped quickly and extensively throughout the clearance between both members.

When the air feed valve 18 is closed, an idle reciprocating motion of the injection piston 9 which is applied with the lubricant oil takes place under the condition that the molten metal is not yet poured in order to spread the lubricant oil around the entire inner peripheral surface of the sleeve 7. Specifically, at this stage, the lubricant oil is spread only around the inner peripheral surface located toward the rear end of the sleeve 7 and it is necessary that the oil be spread around the entire surface. When the second touch sensor 27 detects that the injection piston 9 is located at the advanced end, the controller 25 opens the air feed valve 18 to feed the air into the groove 21, or more specifically, into an annular space Y located between the groove 21 and the outer peripheral surface of the connecting rod 22 which is inserted into the sleeve 7 and having a greater clearance therebetween than in the remainder, thus removing metal residues (burrs) and metal powders which are left within the groove 21 by blowing them away.

The injection piston 9 is then retreated to move away from the second touch sensor 27, whereupon the air feed valve 18 is closed. Subsequently, the movable die 4 is brought into abutment against the fixed die 3 to define the casting space 5, and the molten metal is poured into the sleeve 7 through the gate 10 by pouring means, not shown. Upon completion of the pouring operation, the injection piston 9 which is now located at the retreated position is driven forward to the advanced position, injecting the molten metal of aluminum alloy into the casting space 5.

When removing a casting, in response to an input from the second touch sensor 27 indicating that the injection piston 9 is located at the advanced position, the air feed valve 18 is opened to feed the air into the annular space Y formed between the groove 21 in the sleeve 7 and the outer peripheral surface of the connecting rod 22, thereby removing metal residues (burrs) and metal powders by blowing them away.

Subsequently, the lubricant oil feeding means 2 repeats the described operation.

It will be understood from above description that the use of the lubricant oil feeding means 2 allows the lubricant oil to be spread more quickly and more extensively as compared with the prior art, thus enabling the useful life of the sleeve 7 and the injection piston 9 to be improved as compared with the prior art.

In the above description, the air feed valve 18 is opened in following relationship with the lubricant oil feed valve 20, but this is not an essential requirement, and both valves may be opened simultaneously, thus spraying the lubricant oil into the annular space X.

Also in the embodiment, the air feed valve 18 is opened during the idling operation and during the pouring operation, but this is not an essential requirement and this valve may be opened during only one of these operations.

In addition, the first and second touch sensors used in the embodiment may be replaced by other sensors.

While the invention has been described above in connection with the embodiment, it should be understood that a number of changes, modifications and substitutions therein are possible without departing from the spirit and the scope of the invention, which is solely limited by the appended claims.

What is claimed is:

1. A die casting machine comprising at least a first and second die which are disposed in abutment against each other to define a casting space therebetween, a sleeve mounted on the first die and communicating with the casting space, an injection piston slidably disposed within the sleeve for injecting molten metal supplied into the sleeve into the casting space, drive means for causing the injection piston to reciprocate, and lubricant oil feeding means for feeding a lubricant oil into a clearance between an inner peripheral surface of the sleeve and an outer peripheral surface of the injection piston;

the lubricant oil feeding means comprising a lubricant oil feed passage for feeding a lubricant oil into the clearance between the inner peripheral surface of the sleeve and the outer peripheral surface of the injection piston, and an air feed passage for feeding air into a clearance between the inner peripheral surface of the sleeve and the outer peripheral surface of the injection piston, and a groove formed in the inner peripheral surface of the sleeve at a location corresponding to a retreated position of the injection piston so as to form a space with respect to the outer peripheral surface of the injection piston, the lubricant oil feed passage and the air feed passage being opened to the groove, wherein the air from the air feed passage serves as means for pumping the lubricant oil from the lubricant oil feed passage into the clearance between the outer peripheral surface of the injection piston and the inner peripheral surface of the sleeve via the space and the groove is continuous in a circumferential direction and has a center which is offset upwardly from the center of the sleeve.

2. A die casting machine according to claim 1, further comprising a lubricant oil feed valve disposed in the lubricant oil feed passage to open or close it, an air feed valve disposed in the air feed passage to open or close it and a controller for controlling operation of the lubricant oil feed valve and the air feed valve, the controller making both feed valves open when the injection piston is located in the retreated position and feeding the lubricant oil and the air between the inner peripheral surface of the sleeve and the outer peripheral surface of the injection piston.

3. A die casting machine according to claim 2, in which the controller opens the lubricant oil feed valve before the air feed valve.

4. A die casting machine according to claim 2, in which the controller opens the lubricant oil feed valve and the air feed valve simultaneously.

* * * * *